United States Patent [19]

Lynch

[11] 4,375,183

[45] Mar. 1, 1983

[54] INSULATED SHUTTER ASSEMBLY

[76] Inventor: William R. Lynch, 1311 Kingswood La., Onalaska, Wis. 54650

[21] Appl. No.: 224,928

[22] Filed: Jan. 14, 1981

[51] Int. Cl.[3] ..... F24F 7/00; F24F 13/14

[52] U.S. Cl. ..... 98/110; 98/121 A; 49/DIG. 1; 137/601

[58] Field of Search ..... 98/121A, 110; 137/601; 114/203; 49/89, DIG. 1, DIG. 2

[56] References Cited

U.S. PATENT DOCUMENTS

| | | | |
|---|---|---|---|
| 2,359,289 | 10/1944 | Brown . | |
| 3,084,715 | 4/1963 | Scharres | 137/601 |
| 3,123,098 | 3/1964 | Bishop | 137/601 |
| 3,530,783 | 0/0000 | Alamprose | 98/110 |
| 3,583,171 | 6/1971 | Flynn et al. | 62/266 |
| 3,605,603 | 9/1971 | McCabe | 98/110 |
| 3,783,768 | 1/1974 | Caming et al. | 98/110 |
| 3,964,377 | 6/1976 | Chapman | 98/116 |
| 4,038,781 | 8/1977 | Graham | 49/91 |
| 4,263,842 | 4/1981 | Moore | 98/110 X |
| 4,272,941 | 6/1981 | Hasselbacher et al. | 49/DIG. 1 X |
| 4,294,283 | 10/1981 | Scharres | 137/601 |

*Primary Examiner*—William E. Tapolcai

*Attorney, Agent, or Firm*—Kinney, Lange, Braddock, Westman and Fairbairn

[57] ABSTRACT

An insulated shutter assembly is installed in a ceiling or other wall of a building and used in combination with a ventilating fan for intake or exhaust, such as a whole house fan. The shutter assembly is insulated to substantially prevent heat transfer by conduction and convection through the shutter assembly when it is closed. An integrated mechanical lock system is used with the shutter assembly to provide a positive force against elastic seals when the shutters are closed to thereby provide an airtight barrier against air movement through the shutter assembly. The individual shutter blades are insulated to provide effective resistance to conductive heat losses when closed, and are also shaped to minimize aerodynamic drag and noise when open. The shutters may be manually locked and unlocked or may be motor actuated. The shutter assembly can thus be permanently installed and when the fan is not in use will effectively block heat transfer whether the building is being heated or air conditioned. Whole house ventilating systems save energy because when being operated, a significant reduction in the need for mechanical air conditioning is possible.

34 Claims, 25 Drawing Figures

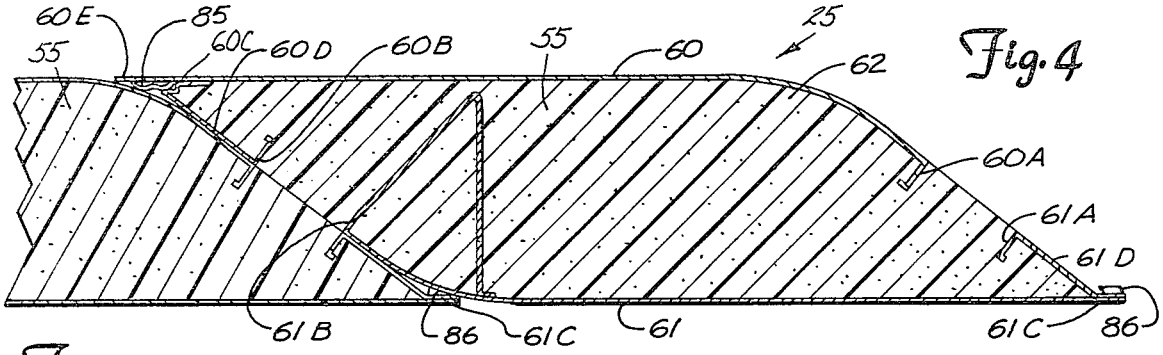
Fig. 4
Fig. 5
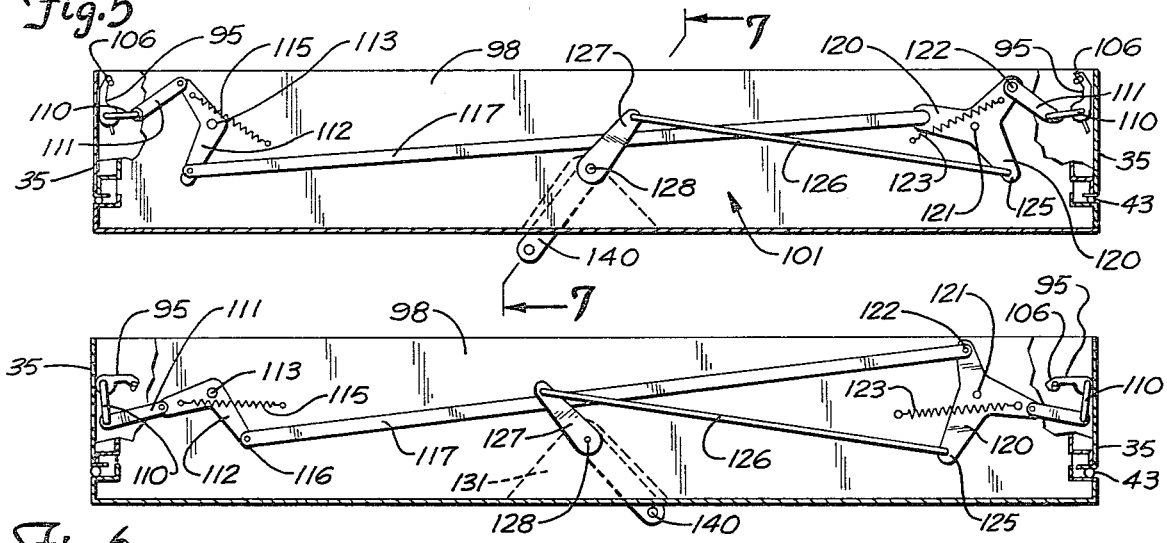
Fig 6
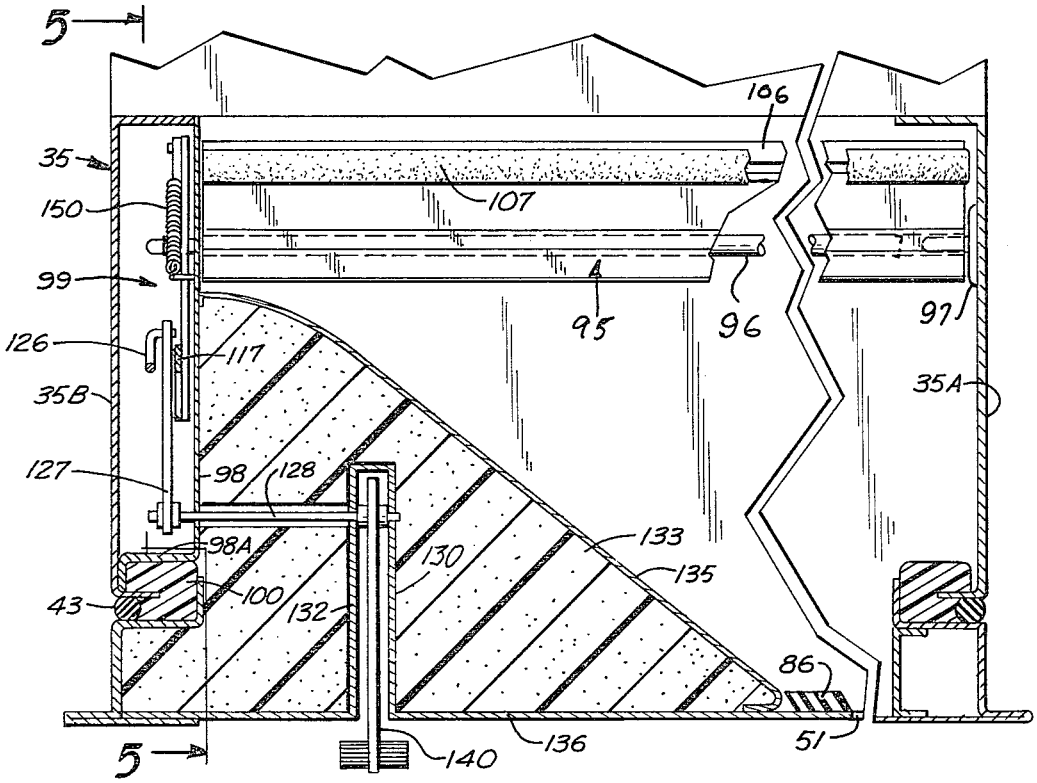
Fig 7

Fig.22
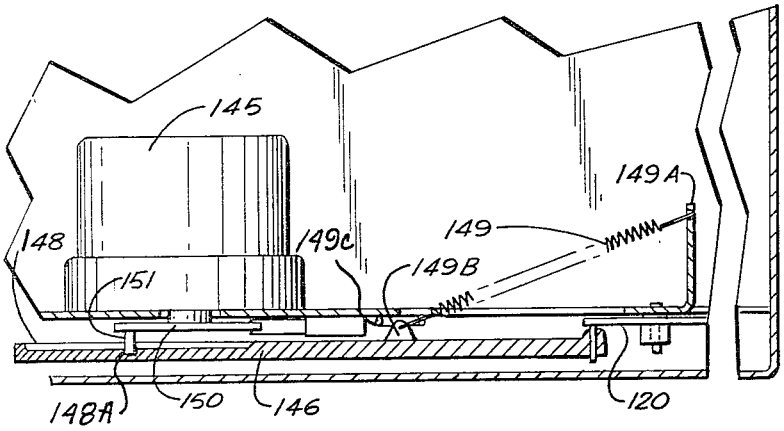
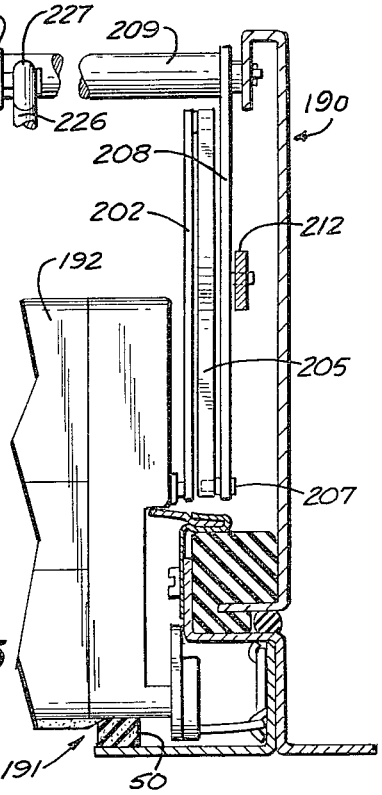
Fig.25
Fig.23
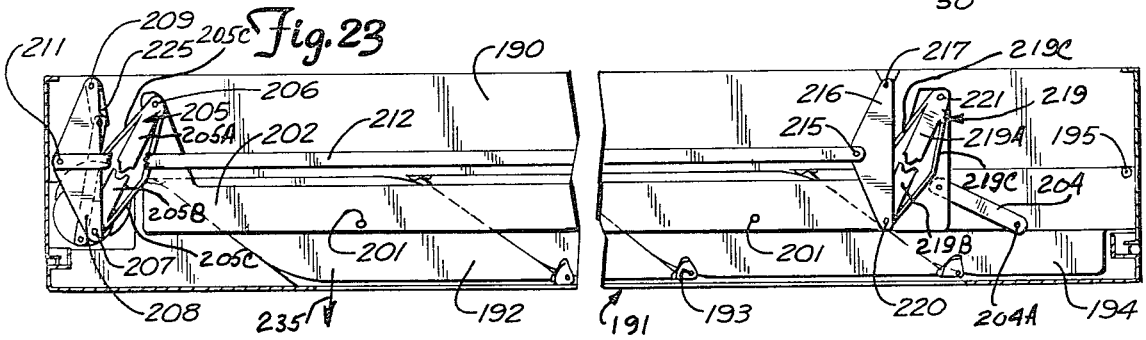
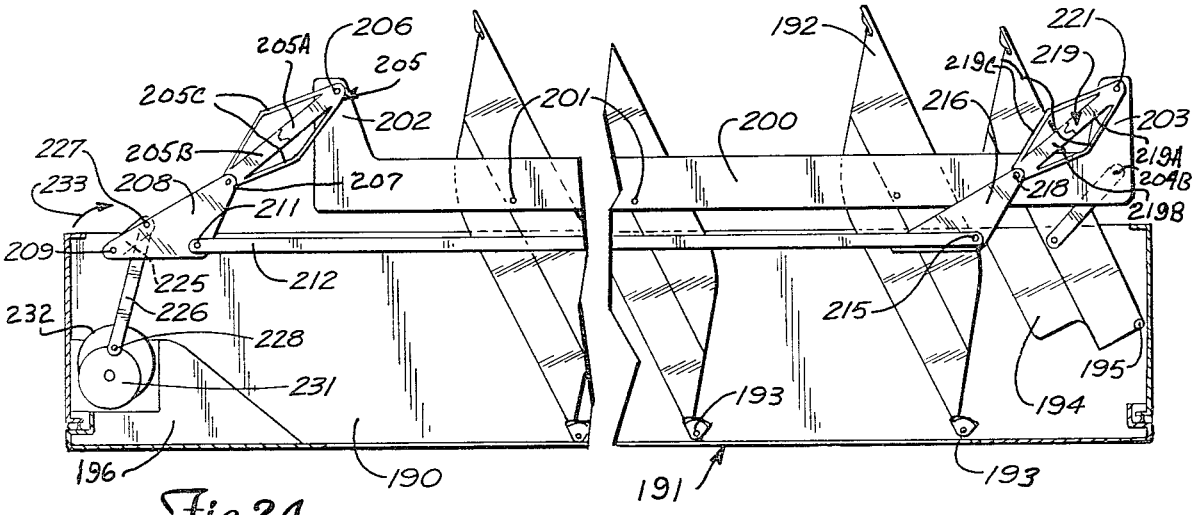
Fig.24

INSULATED SHUTTER ASSEMBLY

BACKGROUND OF THE INVENTION

1. Field of the Invention

The present invention relates to shutter assemblies for whole house ventilation systems.

2. Prior Art

In the prior art there have been various attempts at making useful and operable shutter assemblies, and in certain instances, attempts have been made to provide for insulated shutters and shutter frames. U.S. Pat. No. 3,964,377 to Chapman (FIGS. 6 and 7) includes an illustration of what purports to be insulated shutters that are automatically operable, that is, moved to an opened position when the differential pressure across the shutters is sufficiently large. No mechanism is provided for sealing the shutters positively, and while seals are illustrated, there are gaps in the seals between the individual shutters; the shutters themselves are made so that they would conduct heat from one side of the closure to the other; and there is no means for applying any positive sealing force against the seals so that leakage is substantially uninhibited, even along the seal surfaces. Further, the adjacent edges of individual shutters are spaced forming an air infiltration gap of substantial magnitude. It should be also noted that the construction is shown in U.S. Pat. No. 3,964,377 so that there is a likelihood for binding between the adjacent shutters when they open or close.

The patents cited in U.S. Pat. No. 3,964,377 show various shutter constructions, but none appeared to be pertinent to the idea of providing automatically controllable insulated shutters. An insulated box or enclosure is disclosed in Flynn U.S. Pat. No. 3,583,171 (cited as a reference in U.S. Pat. No. 3,964,377) that is without automatic operation. Also, Bishop U.S. Pat. No. 3,123,098 cited in U.S. Pat. No. 3,964,377 shows a multiple louver damper which has individual shutter blades that carry seals at the outer edges and wherein sealing strips are installed along the hinge axis of each of the blades along the sides, again relying only on the blade weight for a sealing force. It further can be seen that the blades in Patent '098 are not insulated blades, and no positive seal force against the blades is provided.

U.S. Pat. No. 3,530,783 shows an inflatable damper seal that is held in place along the edges of the damper blade where the blades mate. A damper construction is shown in U.S. Pat. No. 3,605,603 including a plurality of pivoting noninsulated blades, and wherein the blades are made to attempt to provide a seal which engages during pivoting of the blades.

Streamlined or aerodynamic shutter blades are shown in U.S. Pat. No. 3,783,768 and also edge seals are illustrated in this particular patent. Again, no positive force can be applied to the blades and seals for positive sealing. The blades also are not constructed for maximum insulation purposes.

A similar type of pivoting shutter blade having vinyl seals along the side edges and at the hinge axis is shown in U.S. Pat. No. 4,038,781. The Scharres U.S. Pat. No. 3,084,715 shows pivoting shutter or damper blades that have resilient edges that engage each other for sealing purposes. Also there are seals at the ends of the unit, again with no apparatus which provides positive sealing forces.

U.S. Pat. No. 2,359,289 also shows a pivoting blade shutter assembly that has flexible seals along the ends of the shutter blades, and which does have a shutter operating lock that retains the shutters in either open or closed position. Light blocking shields are provided, but no teaching is made of providing a sealing arrangement for preventing air passage through the assembly.

Thus, in all of the prior art, there is no showing of a highly efficient insulated shutter assembly that provides for positive sealing of the shutter blades in a closed position to insure that heat transmission through the shutter is minimized during times when the shutter is not used for ventilation. The shutter assembly of the present invention is effective to prevent heat from infiltrating into the house during the time when air conditioning is being used and also to prevent heat from escaping from the house when the house is being heated.

The above patents primarily show the traditionally constructed thin metal louvers that provide a minimum air seal against back drafts and a barrier against insect or pest intrusion. These shutters all have relatively poor insulating qualities, and lack positive seals which permit the shutter assemblies to be used effectively in houses located in rather severe climate areas.

SUMMARY OF THE INVENTION

The present invention relates to an insulated shutter assembly for use with a ventilating system such as a whole house fan. The shutter assembly is designed to minimize thermal losses through the shutter by conduction and convection.

The shutter assembly is designed to have an insulating value sufficient to suit any climate. For example, R-24 or equivalent can be achieved without compromising efficient operation during the periods of time when the shutters are opened for ventilation purposes. The shutter assembly includes a positive seal mechanism along with insulated shutter blades that provides a high insulating value.

In particular, the shutter assembly includes lightweight blade shells filled with an insulating material, for example polystyrene or polyurethane foam. The outer shell is constructed in a manner to prevent conduction of heat along the shell wall from one surface of the shutter assembly to the other, for example to prevent conduction from the interior of the house to the attic. The blades are lightweight and may be counterbalanced so that they operate automatically on very low differentials of pressure. The blades are made in an aerodynamic form to minimize drag and noise under normal airflow requirements.

The shutter blades are mounted in a mechanical suspension system which, when the shutters are closed, permits some movement of the shutter blades perpendicular to the plane of the wall or ceiling, so that manual, or powered controls may be provided to urge the shutter blades against provided seals along the edges of adjacent blades parallel to the axis of pivoting, as well as between the sides of the blades and the housing.

The suspension maintains a separation between shutters and seals when opening and closing. When the shutters are open, the suspension restrains the shutters against undesirable horizontal and vertical movements and eliminates vibration and noise that can sometimes occur when influenced by normal air turbulence.

The seals that are provided are resilient or elastic to provide an airtight barrier against air movement and infiltration losses by having properly sized and shaped seals and, by providing means to compress the seals with a provided mechanism.

Also, as disclosed, the device can be automatically operated so that each time a fan is turned on to which the shutter controls air, the seals will be released, and when the fan is turned off the sealing mechanism will again be actuated.

In a particular preferred embodiment the shutter blades are controlled to open and close under power each time the fan is turned on. The linkage used provides a force on the seals which is also generally perpendicular to the plane of the shutter opening to positively seal the perimeter of the shutter opening.

Except for a narrow space along each side of the frame which is insulated by closed air pockets, the entire opening of the frame for the shutters is closed with a thick layer of insulating material, and this is done by providing a false shutter at one end of the frame to fill a normal trapezoidal space that would be uninsulated if one was using only the aerodynamic shaped pivoting shutters.

It should be noted that using an attic fan for ventilating the house does effectively reduce energy consumption by reducing the need for air conditioning, particularly in the northern climates. However, if shutter assemblies are not adequately sealed and insulated, in the northern climates they are not considered worthy of use because of the great heat losses during the wintertime. The present device overcomes these shortcomings, and when properly installed will permit usage of permanently installed attic fans even in the northen regions of the country without need for special covers for the assembly. Insulated shutters are useful in all climates. For example, in southerly climates which rarely need winter heating, insulated shutters are useful at those times when air conditioning is in use, because of the extremely high temperatures reached in the attics of such homes. Moreover, an unsealed closure at the attic opening would allow a very substantial amount of unwanted heat gain through infiltration that can be avoided by such shutters.

BRIEF DESCRIPTION OF THE DRAWINGS

FIG. 4 is a sectional view taken as on line 4—4 in FIG. 3;

FIG. 5 is a view taken along line 5—5 in FIG. 7 as shown actuating linkage for the locking mechanism used with the shutters of the present invention;

FIG. 6 is a sectional view taken along the same line as FIG. 5 with the linkage in a shutter locked position;

FIG. 7 is a fragmentary sectional view taken as on line 7—7 in FIG. 6;

FIG. 22 is a sectional view taken generally along line 22—22 of FIG. 20 showing the detail of a safety release mechanism for the motor drive;

FIG. 23 is a sectional view along one side of the shutter assembly showing a modified form of motorized shutter closures with the shutters in a closed position;

FIG. 24 is a view taken generally along the same line as FIG. 23, with the shutters shown in their open position; and FIG. 25 is a fragmentary sectional view taken along line 25—25 in FIG. 23.

DESCRIPTION OF THE PREFERRED EMBODIMENTS

The insulated shutter assembly of the present invention is integrated to provide for safe, reliable operation. In all embodiments upon actuation of a fan the shutters open automatically, noiselessly, and efficiently, but that when the fan is not to be used, either because it is desired to use air conditioning in the home, or to heat the home, the shutter assembly is locked and when locked the assembly resists any transfer of heat between the interior of the house and the exterior. In one form of the invention, the shutters are operated by the air pressure generated by the fan. In another form of the invention the shutters are motor operated between open and closed position.

Because the shutter assembly as shown is designed primarily to be mounted in the ceiling of a house, and thus horizontally, with an exhaust fan exhausting out through the attic, reference will be made to horizontally and vertically in relation to the positioning of the various members. The insulating and sealing features are also applicable to vertically oriented shutters.

The shutter assembly illustrated generally at 20 is made up of a number of component elements, each of which is individually designed for good insulation purposes. The shutter assembly includes a perimeter frame 21 which has a fan mounting shroud or plenum 22 attached thereto. The fan mounts on a flange 23 at the upper end of the plenum. The plenum is conventional, and can be used for mounting any type of a whole house fan on the upper end of the unit. When discussing the perimeter frame, the discussion will deal with the portion below the plenum.

Figure 1:
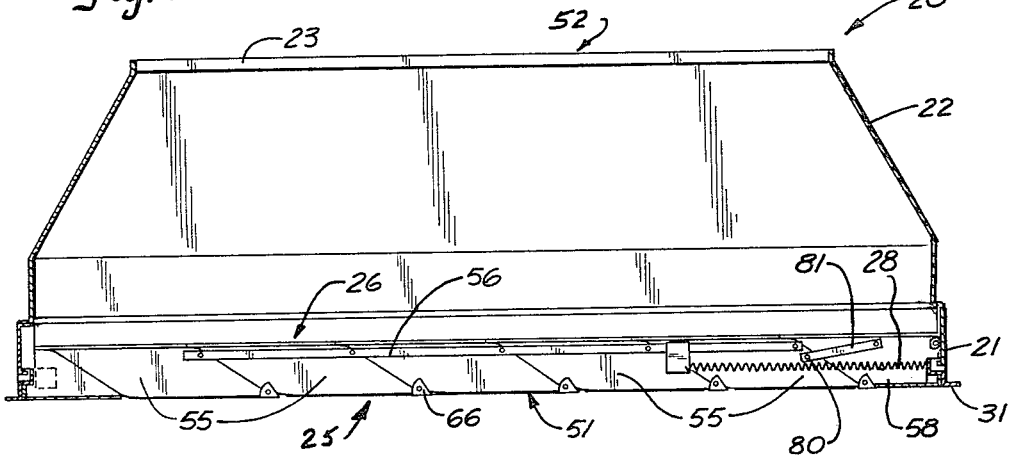
FIG. 1 is a vertical sectional view of a typical shutter assembly made according to the present invention showing an upper fan shroud in place on the assembly and with the shutters in a closed position.

Additionally, the shutter assembly of the present invention includes a shutter blade assembly indicated generally at 25 made up of individual shutter blades as will be explained, that are linked to pivot in unison between a closed position as shown in FIG. 1 and an open position shown in FIG. 2. Further, the shutter assembly includes linkage means 26 that are positioned along each side of the shutter frame 21 and which include actuating mechanisms for holding the shutter assembly 25 in a closed position. A counter balance spring 28 is also used to counter balance the weight of the shutter.

1. Perimeter Frame Assembly

Figure 8:
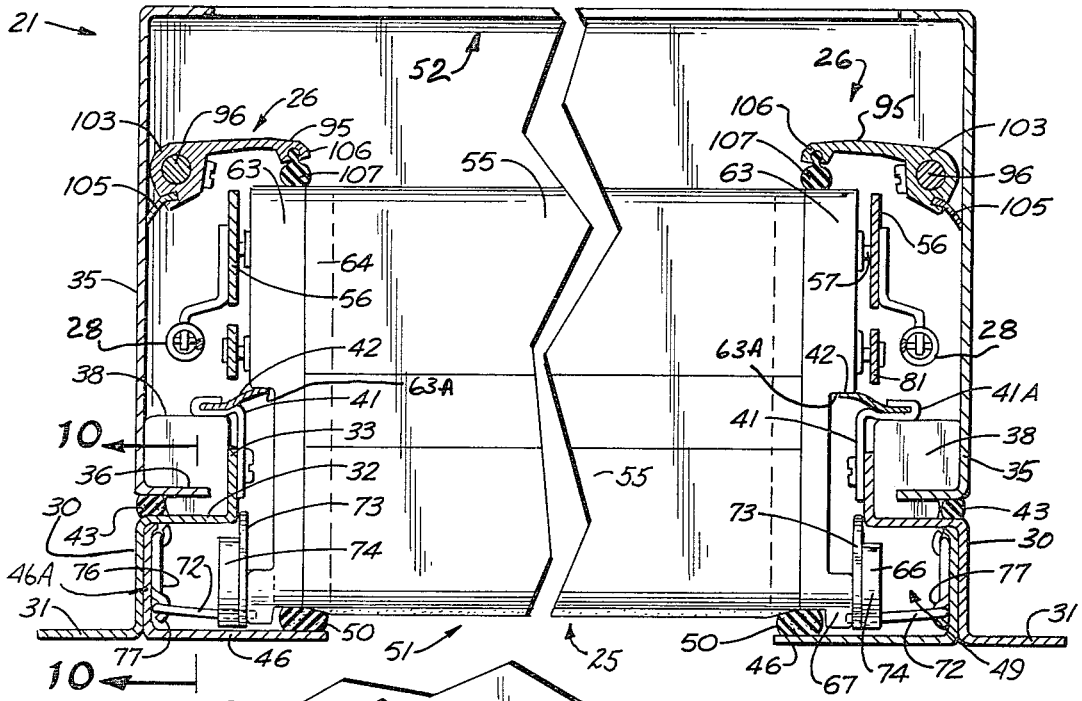
FIG. 8 is a sectional view taken as on line 8—8 in FIG. 1 with parts in section and parts broken away.

Referring specifically to the details of construction of the perimeter frame 21, the cross section is perhaps best seen in FIG. 8. The perimeter frame includes a plurality of perimeter wall sections that are formed in a desired manner which are provided with means not only to seal against conduction of heat from the interior of the house to the exterior, but also to minimize vibration and noise.

As shown in FIG. 8, the perimeter frame assembly 21 is rectilinear and is formed with side and end walls. A lower frame section 30 is a perimeter frame section that has a flange 31 extending around the perimeter. The flange is used for mounting the frame assembly to a surface such as a ceiling or other support defining the opening in which the shutter assembly is placed.

The lower frame section 30 has an offset wall section 32 that extends inwardly from the vertical wall portion of the lower frame and this offset wall section 32 thus is positioned to the interior of the shutter frame assembly. The offset wall section 32 in turn has a vertical flange 33 attached thereto. Vertical flange 33 extends around the perimeter of the lower frame assembly. For convenience of description, the sides of the frame assembly are the wall members which extend generally perpendicular to the axis of pivoting of the shutter blades, and the ends of the frame are the walls that extend parallel to the axis of pivoting of the shutters.

The lower frame section 30 in turn supports an upper frame section 35 which also is a perimeter frame having an inturned lower flange 36 that is generally parallel to and spaced above the wall 32 of the lower frame. The two frame sections, namely the lower frame section 30 and the upper frame section 35 are held together with a plurality of rubber frame separator blocks 38 having low heat conduction properties. Blocks 38 have a slot which slips over the flange 36 and they rest against the flange 32. Sheet metal screws extending through wall 33 into the blocks hold the frame sections together. The blocks 38 are placed at desired intervals along the frame and provide thermal, sound and vibration isolation between the wall on which flange 31 is mounted and the upper frame section, which supports the plenum and fan.

A seal retainer member 41 extends along the sides of the frame, and is "L" shaped, having a vertical leg which rests on the leg 33 of the lower frame assembly, and a horizontal leg 41A which overlies the blocks 38. The sheet metal screws which pass through legs 33 into blocks 38 also hold the seal retainer in place.

The legs 41A which are the horizontal legs of seal holder 41 have bent over lips which support a resilient seal 42 that has an outer lip portion which engages a shoulder 63A formed on the end caps 63 of shutter blades to form an anticonvection seal along the sides of the shutter assembly. The seal 42 may be any suitable material such as brass flashing or a vinyl strip and forms an insulating air pocket alongside the shutters.

A perimeter elastomeric seal 43 is positioned between the flange 36 and the wall 32 to provide a continuous perimeter air seal between the upper and lower frame sections. Seal 43 is of low thermal conductivity and provides an adequate draft seal. Additionally, the lower frame portion 30 carries a main seal support flange 46 at the lower edge thereof along the side walls of the frame, but not along the ends of the frame. The horizontal flange 46 is on a same plane as the flange 31, and flange 46 is supported with a vertical leg 46A which attaches to the vertical leg of the lower frame section 30 in a suitable manner. The flange 46 has an elastomeric seal 50 thereon (on the inside of the frame and on the top surface) which is aligned with the sides of the shutter blades, as will be more fully explained. Seal 50 provides for the main draft seal of the shutter blades between the interior of the room, which would be on the lower side of FIG. 8 and the attic which is at the upper edge of FIG. 8.

The frame end wall construction is generally the same as that shown for the side wall constructions in FIG. 8 except the flange 46 is replaced by a larger structure. The upper and lower frame assemblies surround the shutter assemblies. Depending on the type of mechanism that is used for actuating the shutter blades, the wall construction can vary slightly. The perimeter seal 43 does extend all the way around the perimeter of the frame between the lower frame section 30 and the upper frame section 35. The parts can be held together where necessary with suitable fasteners such as rivets or other types of sheet metal fasteners.

2. The Shutter Assembly

The shutter assembly 25 fits within the opening defined by perimeter frame 21, and as will be explained is sealed with respect to the perimeter frame so that when the frame is mounted in a wall or ceiling there is a substantial insulation value, and no convection currents are permitted between the inlet opening 51 defined at the lower end of the perimeter frame and the outlet opening 52 at the top of the frame, leading to the plenum 22.

The shutter assembly 25 is positioned within the frame between the two openings. The shutter assembly 25 includes a plurality of individual shutter blades 55, each of which is pivotally mounted with respect to the perimeter frame, and a connecting link 56 is (see FIG. 2) pivotally connected to each blade 55 as at 57. The shutter blades must pivot in unison, and in the first form of the invention if a differential pressure is present sufficient to pivot the shutter blades, they will all pivot together.

As will be explained, for insulation purposes, a special end shutter blade or member 58 is utilized adjacent one end of the frame to fill the trapezoidal space left above the last operable shutter blade. Blade 58 is called a false shutter because when the shutters are open substantially, no air flows past that shutter.

The individual shutter blades are aerodynamically shaped as best can be seen in FIG. 4, and comprise thin, metal or plastic outer shells 60 and 61 at the top and bottom respectively. The shells are spaced and are molded together with a filling of a rigid foam indicated at 62, for example polystyrene foam has been found to be suitable. When constructed of metal, the shells 60 and 61 are not continuous in the direction of airflow as can be seen in FIG. 4. The shell 60 has a flange 60A adjacent the pivoting end of the shutter blade, and an inturned flange 60B adjacent the outer or free end of the blade. The shell 61 has a flange 61A adjacent the pivoting end of the shutter blade, and a web or flange 61B formed adjacent the free end of the shutter blade. It can be seen that the flanges 60A and 61A are spaced apart, and foam material is placed between them, so that there is no heat conductive path along the metallic surface of the shell extending from the lower shell 61 to the upper shell 60. Likewise, the flanges 60B and 61B are spaced and are not thermally connected. A plastic veneer having low heat conductivity may be positioned between these flanges.

The construction of the blades 55, therefore, is such that there is no direct thermal conductive path from the interior of the house to the attic along the surfaces of the shutter blades. The shells 60 and 61 can be made of very thin aluminum, for example, and the ribs or flanges 60A and 61A, and 60B and 61B serve to anchor the shells to the rigid body of the foam and to form a lightweight composite structure providing stiffness and rigidity in transverse direction across the shutter blades. Each shell segment may be formed in one or more pieces joined in any desired, suitable manner.

A lip 60C is formed adjacent the outer-most edge of the shell 60 by extending an upper wall of the shutter beyond the wall portion 60D together, and a lip 61C is formed adjacent the pivoting edge of the lower shell 61 again by extending the lower wall beyond the wall portion 61D. A transverse anticonvection (air pocket) seal 85 is carried under lip 60C and a main transverse airflow seal 86 is mounted on lip 61C. The adjacent blade will be seated on seal 86 as will be explained.

Figure 3:
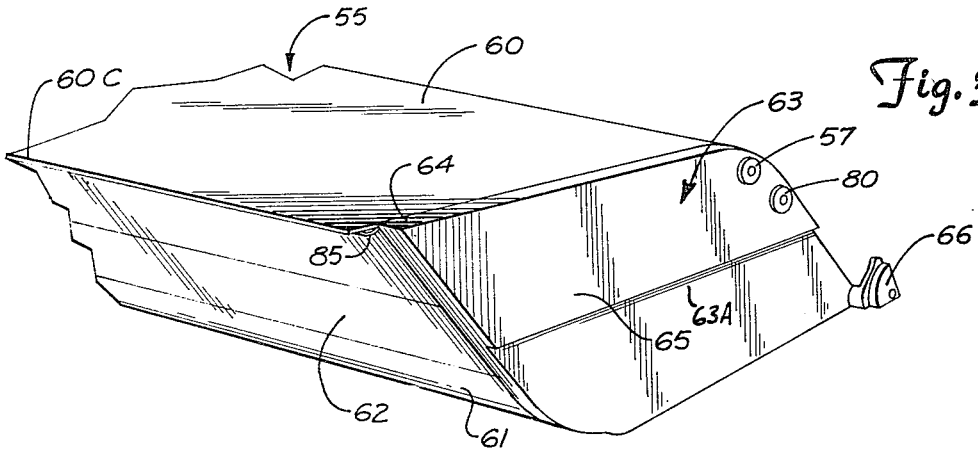
FIG. 3 is a fragmentary perspective view of a shutter blade showing an end cap member.

The shutter blades have end caps 63 at opposite ends thereof (see FIG. 3 for example) which form the ends of the units, and will provide for the mounting for pivot connections and for seals.

Figure 11:
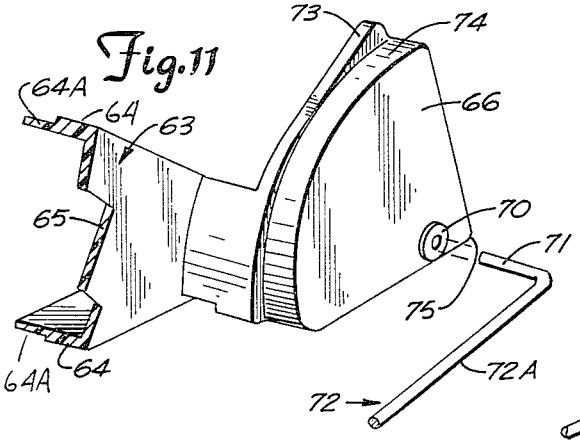
FIG. 11 is a perspective view of a support bearing for a shutter blade member.

The end caps 63 form the members which extend parallel to the sides of the frame. The end caps 63 can be molded from suitable plastic, and the shells 60 and 61 are mounted to flanges 64 on the end caps. The end cap flanges 64 have recesses 64A that the outer edges of the shells 60 and 61 mate with (see FIGS. 11 and 12). The end caps thus are hollow end caps. Before the blades are formed, the shells 60 and 61 are attached to the end caps and then the foam 62 is injected. The end caps themselves are filled with foam and also are made of plastic having low thermal conductivity.

The shoulders 63A form the anticonvection seal surfaces for seals 42. When the shutters are closed the shoulder surfaces 63A lie on a plane for sealing along the length of the shutters.

The end caps 63 mount the hubs or housings used for pivotally mounting the individual shutter blades. As can perhaps best be seen in FIGS. 11 and 12, the flange 64 is joined to an end wall 65 of each of the end caps 63.

3. Mounting Of The Shutter Blades

Adjacent the pivoting end of the shutter blades, there is a hub 66 integrally formed with each of the end caps and joined through a junction section 67 to the end cap wall 65. The retainer hubs have a pivot bearing member 70 into which a shutter blade support shaft 71 of a spring arm 72 is mounted. The bearing member 70 on the opposite end caps 63 align to form the pivot axis for the shutter blades. The shafts 71 of the support springs 72 on opposite sides of the frame provide a common pivot axis for the end caps of each shutter blade.

The hubs 66 have a cam surface or seat 74 and retainer flange 73 which extends upwardly from the seat 74. The seat 74 acts as a cam surface during pivoting operation of the shutter blades to control the upward movement of the shutter blades. The hubs 66 have a lower cam lobe or surface 75 that also acts to support the shutter blades when they are in an open position as will be more fully explained.

Figure 9:
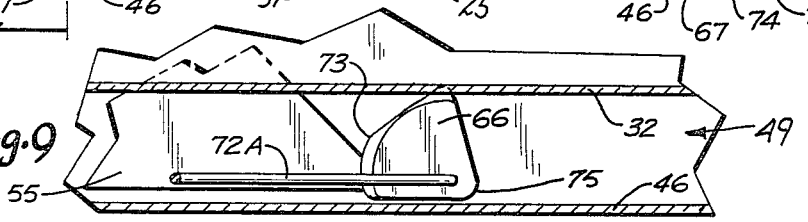
FIG. 9 is a fragmentary sectional view taken as on line 9—9 in FIG. 8.
Figure 10:
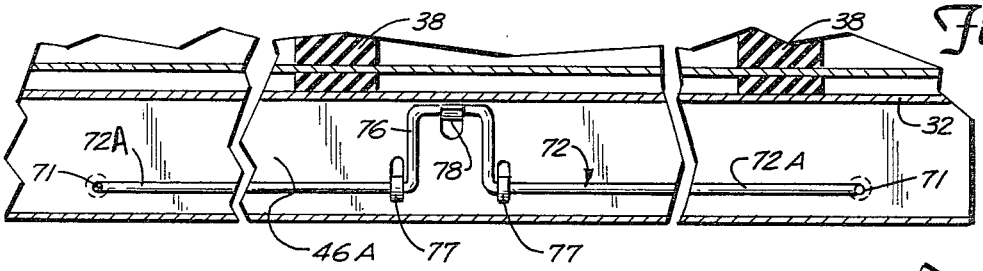
FIG. 10 is a fragmentary sectional view taken as on line 10—10 in FIG. 8.

With reference to FIGS. 9 and 10, in particular, it can be seen that the support springs 72 are shown with double ended arms 72A having shafts 71 at opposite ends. A crank section 76 is in the center portions of each support spring. The support springs 72 are mounted against the vertical leg 46A of the main seal retainer 46, and are held so that the spring arms 72A of the springs 72 are permitted to bend and twist relative to the retainer clips 77, but the crank section 76 is held against rotation with a retainer clip 78 also formed in the leg 46A. The retainer clips 77 are positioned close to the legs of the crank section 76 to prevent the spring arms from shifting in direction along arms 72A in use.

It should be noted that each shutter requires independent support but, for reasons of economy of construction, the springs 72 are shown so that each spring provides support for the end caps of two shutter blades on one side of the frame. There are support springs on both sides of the frame assembly, with the shafts 71 supporting each of the hubs or bearing mounts for each of the blades. With an odd number of shutter blades used in the frame, as shown, the mounting for one of the end blades would use only one-half of the double ended support spring assembly. Similarly, the false shutter is supported by a single ended spring assembly.

Figure 17:
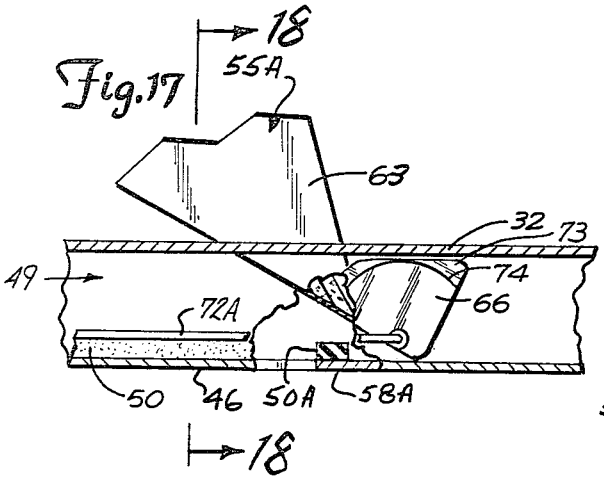
FIG. 17 is a side view of a shutter portion adjacent the pivot of a shutter member with parts broken away for clarity.
Figure 18:
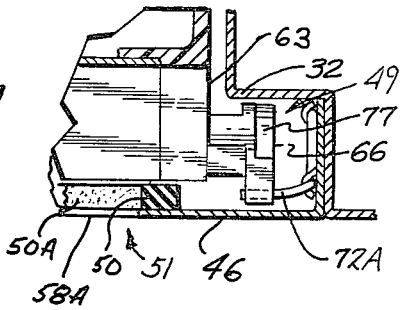
FIG. 18 is a fragmentary sectional view taken as on line 18—18 in FIG. 17.
Figure 19:
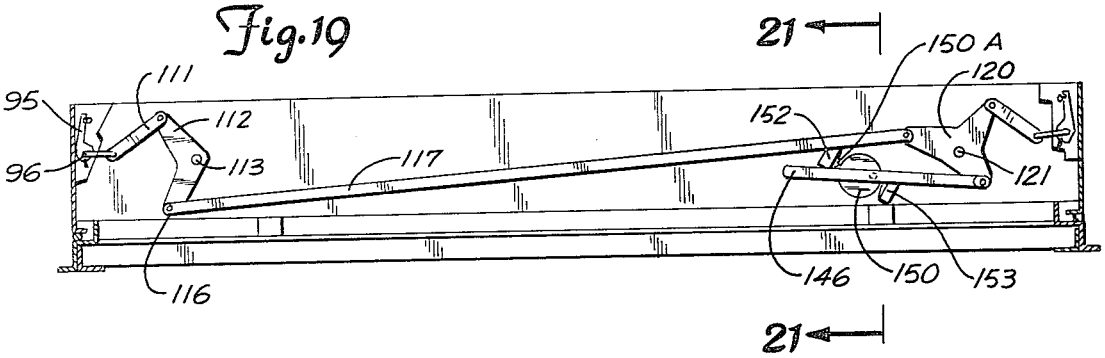
FIG. 19 is an end view of linkage for the shutter lock apparatus when the apparatus is motor operated, and taken generally on line 19—19 of FIG. 21.

Referring to FIGS. 8 and 9, it can be seen that the hubs 66 of the end caps, when supported on the springs 72 are made so that the retainer flanges 73 of the hubs on the opposite end caps of the same blade are positioned between the vertical flanges 33 of the lower frame 30. Because the flanges 73 face to the interior of the frame members, they prevent the shutter blades from moving sideways that is, in direction along their pivot axes during use. The springs 72 are formed so shafts 71 provide a resilient force tending to urge the seats 74 up against the underside of the horizontal wall 32 of the lower frame 30. The spring arms 72A will twist or bend enough so that the shutters can move in vertical direction without a great effort. However, horizontal (side to side) movement is prevented by flanges 73. The flanges 73 are recessed at one location to aid in installation. FIGS. 17 and 18 show hub 66 inserted into chamber 49 enabling installation of the opposite hub.

Figure 2:
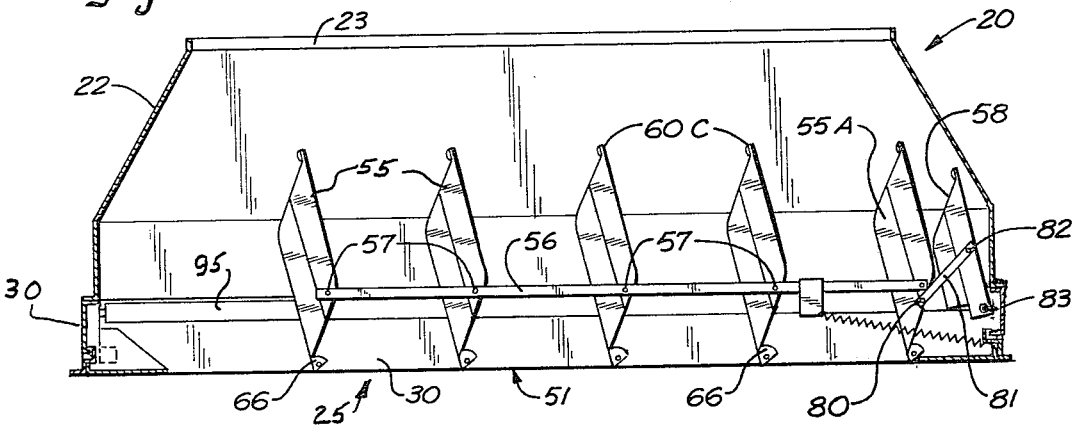
FIG. 2 is a sectional view of a shutter assembly made according to the present invention with the shutters in open position.

The end cap 63 on the one end shutter blade indicated at 55A in FIG. 2 has a pivot bearing 80 for pivot connection of a link 81 that in turn is pivotally connected as at 82 to the false shutter blade 58. Additionally, the false shutter 58 is pivotally mounted at bearing point 83 with a spring attached to the side of the frame as done with the main shutter blades. The bearing point 83 is formed in the end caps near the upper corner of the false shutter. Thus, the end cap for the false shutter blade 58 is different from the end caps 63 for the rest of the shutter blades. It is a different size and has different bearing supports.

The pivoted end of the end shutter blade 55A also has a different cross seal in that it is at the edge of the opening 51. A wall 58A extends between the sides of the frame below the false shutter 58. At the edge of opening 51 as shown in FIG. 17 the wall 58A supports a cross seal 50A on a level with seals 50 and joining the seals 50. The seal 50A is below the shutter blade 55A adjacent its pivoted end and when the shutters are locked as will be explained the edge of blade 55A is compressed against seal 50A to provide a primary seal along the edge of opening 51 across the frame.

When the shutters are in closed position shown in FIG. 4, the transverse junctions between adjacent shutter blades 55 are sealed across the frame. This sealing is accomplished for most of the blades with the cross seals 86 which are attached to the lips 61C adjacent the pivot edge of the blades. The seals 86 seal against the under surface of the free end of the adjacent blade. Lightweight upper seals 85 form insulating air pockets and discourage convection currents between adjacent shutters above the seals 86.

The upper seal 85 extends all the way across the shutter blade and seals along the outer surface of the top rear corner of the adjacent shutter blade. Also, the lower seals 86 extend all the way across the shutters to the outer edges of the end caps. The lower seals 86 overlap the main seals 50 as seen in FIGS. 13–16 in particular, and a potential air leak is corrected by special design of the shutter end caps. This is shown specifically in FIGS. 13 through 16. First, the lip 61C is extended laterally so it overlies seal 50 and it is beveled or tapered to insure that seal 50 closes around the lip end for effecting an air seal. It can be seen that the cross seal 86 also extends over seal 50 and underneath the end cap 63 of the adjacent shutter blade. Each of the flanges 64 has a special lobe 90 formed right at the curve between the bottom of the end caps and the upwardly extending wall at the free (unpivoted) end of the blade.

The lobes 90 protrude downwardly below the general plane of the shutter blade and the shell 61 so that when the shutter is locked closed as will be explained, the shape of flange 64 with lobe 90 compresses the end of seal 86 and the main seal 50 together around tapered lip 61C. The sealing of the seal 86 supported by the lip 61C is continuous across the width of the adjoining shutters creating an airtight closure even at the junction between seals 86 and 50. The lower surface of flange 64 of the end caps also engage the main seal 50 when the shutters are sealed.

Figure 12:
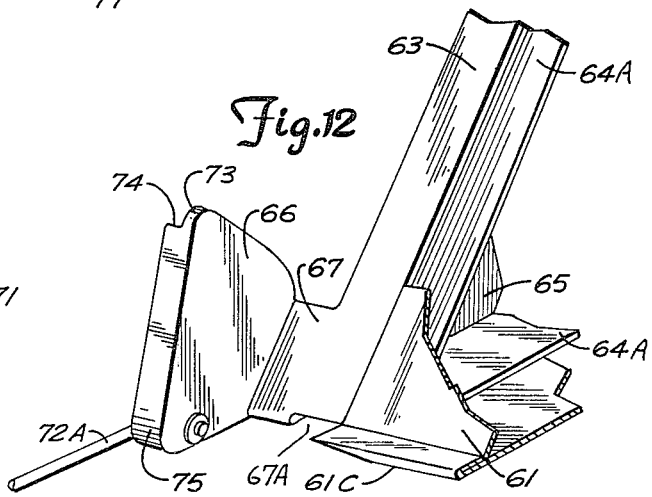
FIG. 12 is a perspective view taken from a shutter bearing member taken from the opposite side from FIG. 11.
Figure 13:
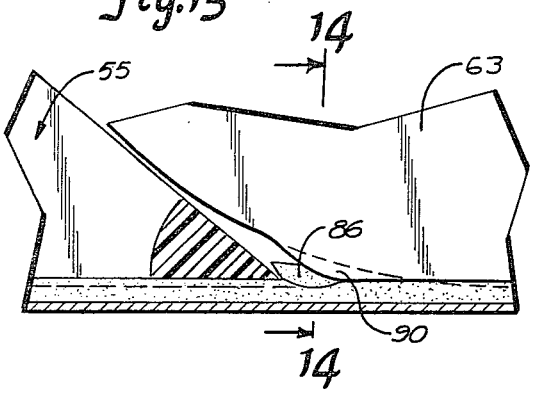
FIG. 13 is a fragmentary side view of a junction portion between two of the shutter blades.

It also should be noted that the supports 67 are recessed as shown in FIG. 12 as at 67A so that the main seal 50 is not compressed an extra amount in the area where the hubs 66 are mounted when the shutter is moved to a sealed position.

4. Shutter Movement And Operation

Figure 15:
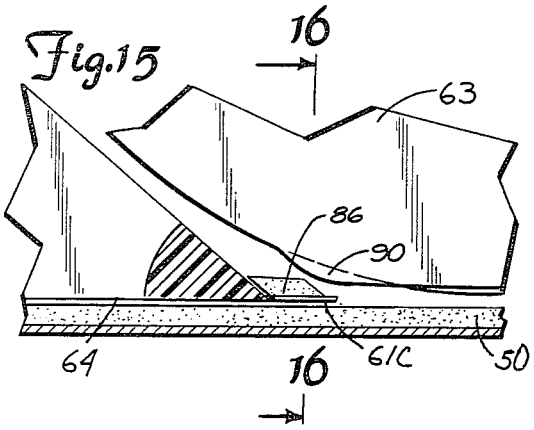
FIG. 15 is a view taken along substantially the same line as FIG. 13 with the shutters in a partially open position.
Figure 16:
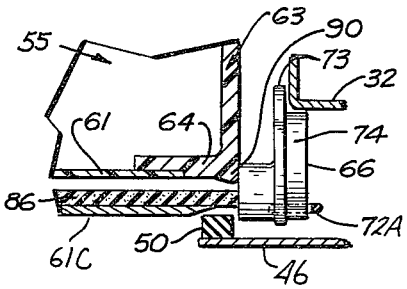
FIG. 16 is a sectional view taken as on line 16—16 in FIG. 15.

When the shutter blades 55 are in closed position but not sealed, the hubs 66 are positioned as shown in FIGS. 15 and 16. The support arms 72A provide a lifting force to the shutters 55 which is restrained by cam surface 74 engaging the flange 32. The cam surfaces 74 are designed to control the vertical position of the shutters so that during the angular movement of the shutters from the closed to the open position, a separation is maintained between flange 64 and main seal 50. As the shutters move to open position, the cam surface 75 engages the flange 46, as shown in dotted lines in FIG. 9, to directly support the shutter hubs on the perimeter frame without applying any spring load. In this manner fluttering that is possible if the shutters were supported only on the spring arms 72A during operation is avoided. In other words, the springs do support the shutters as the shutter blades move to open position. Once the blades are open, the cam lobes 75 mechanically support the shutter blades on each end thereof on the flange 46.

For insuring a draft-free, completely sealed shutter assembly, in addition to the cross seals just described which are between the junction of the individual shutter blades 55 the linkage means 26 include compression beams 95 along the sides of the frame and above the shutter blades. The compression beams can be moved between open and locked positions. In the locked position, the compression beams 95 exert a positive force against the sides of the shutter blades to load the shutter blades downwardly against the main side seals 50 and cross seals 86 and 50A and also provide a positive pressure or force compressing the transverse or cross seals between the individual shutter blades. The compression beams prevent the shutter blades from opening once the beams are in their locked position.

While it is preferred that power operation as will be described is provided for the compression beams, a simplified mechanical operation will be explained first for simplicity.

Referring to FIGS. 1, 2 and 5 through 8, it can be seen that a pair of longitudinally extending compression beams 95 are mounted on longitudinally extending shafts 96 which in turn are rotatably mounted in opposite end walls of the frame. As can be seen in FIG. 7, on the upper frame 35, and in particular the one end wall 35A, there is a suitable small hub or bearing 97 attached in which the shaft 96 is rotatably mounted.

At the opposite end of the frame, where an actuator is provided, a cross wall 98 is spaced inwardly from an end wall 35B of the frame 35 to form a chamber or housing 99. The wall 98 is parallel to the end frame wall 35B, and has an inwardly directed leg 98A that joins wall 35B. Wall 98 is mounted on suitable blocks 100 that can be rubber or other flexible material. Thus, the end wall construction at the actuator end is slightly different from the sides of the frame.

The end wall 98 can also have a hub 97 for receiving the shaft 96. The shaft 96 extends all the way through this wall to provide for mounting of an actuator mechanism shown generally at 101 in FIG. 5.

The compression beams 95 as can be seen extend the full length of the frame along the sides, and are positioned quite closely adjacent the sides. The beams, however, are within the walls 35A and 98, and do not extend through the walls. The shafts 96 extend through the wall 98, for mounting suitable actuating arms and the like which will be explained, and which are shown somewhat schematically for simplicity.

In particular, referring to FIG. 8, it can be seen that the compression beams 95 have a hub end 103 in which the shafts 96 are mounted. One suitable set screw 104 is provided for locking each actuator beam onto its respective shaft 96 in the center portions of the compression beam. The shafts 96 also act as torsion springs to load the compression beams. As the shafts are rotated from one end of the shafts the respective compression beams rotate. The hub ends 103 of the beams also mount flexible blade-like seals 105 along one edge thereof, and these seals, when the actuator beams 95 are in locked position as shown in FIG. 8, engage the inside surfaces of the side walls of the frame member 21 to provide an anti-convection seal.

The compression beams 95 also have integral webs projecting out from the hubs 103, and these webs support and form a compression beam head 106 that in turn has a longitudinally extending elastomeric seal 107 mounted in a provided slot. Seal 107 extends all the way along the length of the compression beams.

Figure 14:
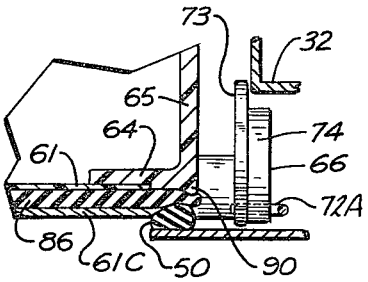
FIG. 14 is a sectional view taken as on line 14—14 in FIG. 13.

When the compression beams 95 are in their locked position, the seals 107 bear against the upper surfaces of the shutter blades 55, and exert a downward force (parallel to the side walls) urging the shutter blades against the main seals 50 all along the side of the shutter opening. This force not only urges the lower edges of the end caps against seal 50, but also urges the lobes 90 against seals 86 to provide a positive seal in that region. The junction lines between adjacent shutter blades also have a positive seal force along seals 86. The support springs 72 and the shafts 71 permit some downward movement of the shutter blades under compression beam forces, so that the surface 74 will move slightly away from the lower surface of wall portion 32 as shown in FIG. 14. A positive sealing force is thus provided in the locked position along the perimeter of the shutter and along each blade junction line. It can also be seen that when the compression beams are in their closed, locked position the shutter blades cannot open. The false shutter 58 also is moved downward in unison with the shutter assembly 25, and anticonvection seals similar to 42 are compressed.

FIGS. 5, 6 and 7 show one form of mechanism for manually locking the compression beams 95 into position. The outer ends of the shafts 96 have actuator arms 110 drivably mounted on the shafts in a suitable manner. The arms may be bent from the shafts themselves if desired. The actuator arms drive the shafts 96. The actuator arms 110 are connected by links 111 to further members of the actuating assembly.

As can be seen in FIGS. 5 and 6, the links 111 for a first of the compression beams shown to the left of FIGS. 5 and 6 is pivotally mounted to one end of a bell crank 112 which in turn is pivotally mounted as at 113 to the end wall 98. The bell crank is spring loaded with a spring 115, one end of which is anchored to the bell crank and one end of which is anchored to the wall 98. The opposite end of the bell crank 112 from its connection to link 111 is pivotally connected as at 116 to an elongated link 117, the other end of which is in turn pivotally connected to an actuator crank mechanism 120. The crank mechanism 120 is pivotally mounted as at 121 to the wall 98, adjacent the second of the compression beams 95. The crank member 120 has three actuating arms. A second link 111 is pivotally connected to a second arm as at 122. The second link 111 is in turn mounted to an arm 110 to drive the shaft 96 for the compression beam 95 along that side of the shutter assembly. A second spring 123 is also connected between wall 98 and crank member 120.

A third arm 125 of the crank member 120 is drivably connected to a tension link 126 which in turn is connected to an arm 127 that is mounted on a shaft 128. The shaft 128 is suitably mounted in the wall 98 for rotation, and extends to be rotatably mounted relative to a wall 130 that forms a triangular receptacle indicated generally in dotted lines at 131 in FIGS. 5 and 6. A second wall 132 forming the receptacle has an opening through which the shaft 128 extends and is provided with a conventional shaft seal, such as an O-ring seal to prevent the flow of air through the shaft opening. This can be just an opening in foam 133 which is provided for insulation between the end wall 98 and the lower portion of the shutter frame. An end closure wall 135 is formed at that end of the frame to fill in the triangular shaped opening between the free end of the last one of the shutter blades 55 adjacent that end of the frame and a lower wall 136 that is provided between the sides of the frame member 35.

The lower wall 136 extends transversely between the side wall portions of the main frame, and at the inner end of the wall 136, where it joins wall 135, the inlet opening 51 commences.

The shaft 128 has a hand actuating lever 140 drivably mounted thereon and extending between the walls 130 and 132. The lever 140 can then be pivoted, to in turn move the arm 127 from the position shown in FIG. 5 to the position shown in FIG. 6. With the arm 127 in position as shown in FIG. 5, it can be seen that the compression beams 95 are pivoted so that the upper ends or hub members 106 and the seals 107 clear the side edges of the shutter blades 55. The blades 55 can operate normally. With the lever 140 moved to the position as shown in FIG. 6, the compression beams 95 are in the position as shown in FIG. 8, wherein the seals 107 engage the upper surfaces of the shutter blades 95 and urge the blades downwardly against the main seals 50 overcoming the supporting force of spring arms 72A and compressing the shutters.

The springs 115 annd 123 are used for urging the respective cranks 112 and 120 either to open or closed position when the lever 140 is moved. The springs go overcenter with respect to the pivots of the respective cranks. In other words, in the position as shown in FIG. 5, both springs 115 and 123 are urging the cranks to hold the compression beams in a retracted or open position, and when the lever 140 is moved to position as shown in FIG. 6, the compression beams are urged through the springs 123 and 115 to their locked position against the shutter blades.

When a mechanical actuating linkage for the compression beam 95 is utilized, the fan motor for operating the whole house fan is controlled independently from a separate switch in a normal manner.

5. Motorized Version of Compression Beam Operation

In FIGS. 19, 20, 21 and 22 a preferred motorized mechanism to automatically lock the shutters under electrical control each time the fan for the whole house fan is turned off and to open the compression beams when the fan is turned on is illustrated.

The linkage for actuating the compression beams is substantially the same as that shown in FIGS. 5 and 6, except that in place of the actuating lever 140, a drive motor 145 having a gear reducer head on it is utilized for operating the compression beam. The cranks 112 and 120, as well as the links 111 are connected in the same manner. The springs 115 and 123 may be eliminated. However, link 126 is replaced with a link 146 that will carry both compression and tension, under motorized operation. The output shaft 147 of the gear reducer-motor extends through the wall 98, and has a crank disc 150 drivably mounted thereon. The crank disc 150 has a crank pin 151 thereon which engages a receptacle in link 146 to drive the link in a reciprocating path as the crank disc rotates.

The pin 151 of the crank disc 150 is drivably connected to the link 146 with a safety release connection, such that if for example a person places his hand in the shutters as they close, the pin 151 will disengage its driving connection and will not hurt the person nor damage any parts of the shutter assembly. A suitable manually operated release member may be used to disable the drive between pin 151 and link 146 if desired to permit the shutters to be opened manually and also to prevent trapping fingers in the shutters if someone is working on them.

The link 146 has a slot 148 defined therein, and the link is held against the crank pin 151 with a spring 149 attached to a suitable bracket 149A on the interior of the wall 98. The spring also is connected as at 149B to the link 146. The pin 151 fits within the slot 148, and the slot has a special recess 148A that receives the outer end of pin 151 for driving engagement. The pin and recess are held in this driving engagement under the resilient force of the spring 149. If the force acting on the link 146 exceeds a desired amount, the spring 149 will permit the link 146 to spring outwardly away from the pin 151 and the pin then will just merely ride in the slot 148 and will not drive the link.

The recess 148A can be made so that it has tapered surfaces defining it, the taper may be selectively made so that there is less force necessary to permit the link 146 to be released when the pin is attempting to drive it in one direction of movement of the link than in the other. For example, the drive recess 148A can be designed so that the crank pin will be capable of exerting a greater amount of force on the link 146 in direction to open the compression beams than the force which can be exerted tending to close the beams. The likelihood of injury to an operator is less when the shutters are opening than when they are closing. Of course, equal force in both directions also can be provided.

A manual release mechanism is provided by a crank member 149C that can be manually operated to tilt the link 146 away from the pin 151 to disengage the pin 151 from the receptacle 147. Spring 149 then returns the locking mechanism to the unlocked position as in FIG. 19. This thereby permits manual operation of the shutter blades to access the assembly interior, and avoid driving the beams to their locked position if the motor is accidentally started.

Likewise, suitable means can be provided in the upper portions of the divider wall 98 adjacent the motor for permitting connection of electrical wiring and passing the wiring out through the top of the shutter assembly.

Crank disc 150 has a cam lobe on its edge, shown at 150A which is positioned to actuate one or the other of a pair of microswitches. For example, a first compression beam open microswitch 152 is mounted above and to one side of the crank disc 150 and a second compression beam closed microswitch 153 is mounted below the disc. The switches 152 and 153 are actuated only when the cam lobe reaches the respective switch actuator.

In addition to the microswitches 152 and 153, a separate switch 154 is positioned to be engaged by one of the shutter blades when the shutter blades move to a closed position. This can be at the base end of the shutter blade, or switch 154 could even be positioned in the wall 135 with the actuator extending to position to be contacted by the adjacent shutter blade. Microswitch 154 is shown schematically in FIG. 21 along with a schematic diagram for electrical operation. Switch 154 can be positioned in any desired location so that it is engaged when the shutter blades have moved to their closed position. That is, the position of the shutter blades when they have moved by gravity at the time that the fan motor is shut off. The switches require very little force to operate so the switch 154 can be positioned in any desired location.

Figure 20:
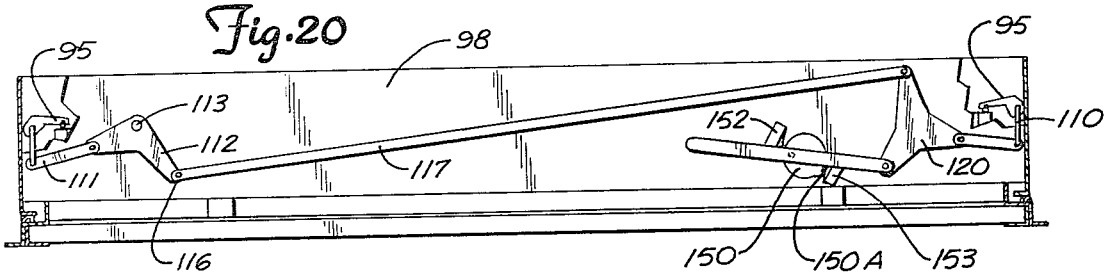
FIG. 20 is a view taken on the same line as FIG. 19 with the shutter lock actuated.

When the fan is turned off and the shutters close, the gear-motor 145 will be powered to rotate the crank disc 150 in direction as indicated by the arrow 156 so that the compression beams will be moved to the position shown in FIG. 20, engaging the shutter blades as previously described to provide a positive sealing force. Each time the fan motor is turned on with a separate manual switch, the gear motor will be energized to rotate the disc 150 another half revolution until the linkage is moved to the "open" or unlocked position shown in FIG. 19. The limit switches 152 and 153, as well as the switch 154 are used for controlling the drives of motor 145.

The microswitch 153 is a normally closed switch, while the microswitch 152 has a set of normally closed contacts and a set of normally open contacts so that regardless of its position, one of the sets of contacts is closed. The microswitch 154 has parallel normally open contacts which are closed when the shutters move to the closed position.

Figure 21:
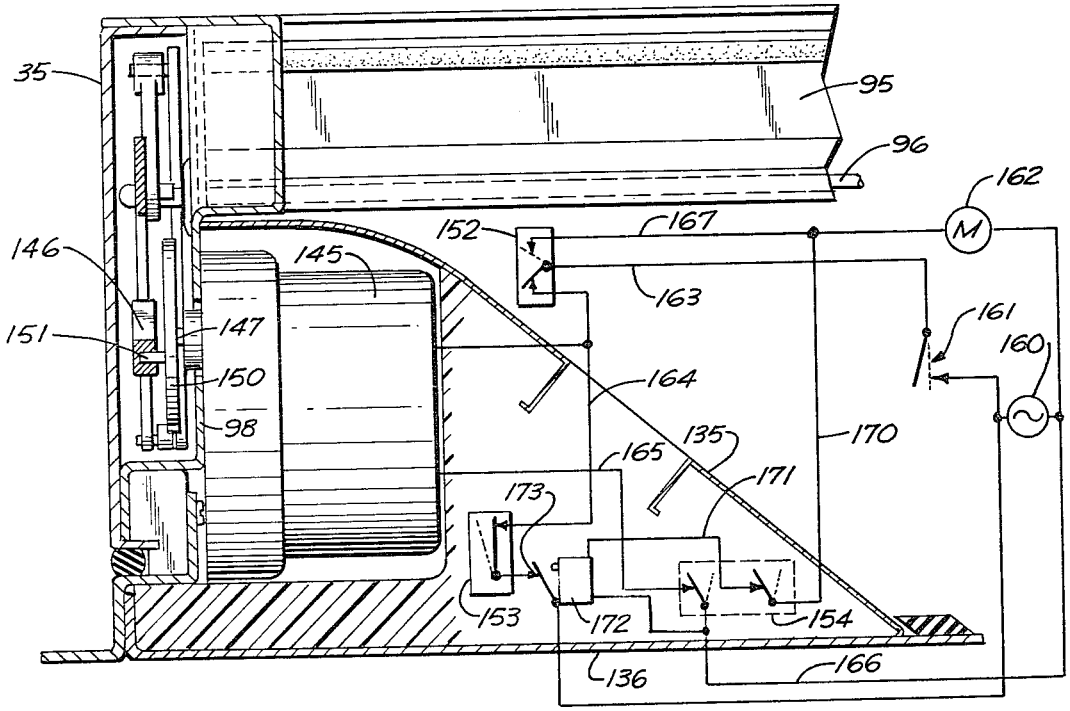
FIG. 21 is a fragmentary sectional view taken as on line 21—21 in FIG. 20 with a schematic representation of an electrical circuit for operating the shutters included.

Referring specifically to FIG. 21, a source of 120 volt power 160 is shown, and the switches 152, 153 annd 154 are shown in position with the shutters closed and the compression beams locked. A manually operable power on switch 161 is shown in open position, and when it is closed to turn on the fan motor 162, a circuit is completed through a line 163 and the normally closed contacts of switch 152 to a line 164 leading to the gear motor 145. The other side of gear motor 145 is connected through a line 165 and one set of the contacts of switch 154 (which has been closed because the shutters are closed) to the power source 160 along a line 166. This energizes the gear motor and crank disc to rotate in the direction shown by arrow 156 to the position shown in FIG. 19 wherein the cam lobe 150A contacts switch 152 and causes the contacts of switch 152, shown closed in FIG. 21, to open and the other set of contacts to close. It can be seen that the compression beams 95 are at that time released so that the shutter blades are free to pivot to open position. When the cam 150A reaches switch 152, it flips the switch into its position wherein the normally closed contacts are opened and the normally open contacts are closed, thereby connecting line 163 to a line 167 and energizing the fan motor 162 and a relay 172. As relay 172 is energized, normally closed contacts 173 are opened which interrupts the power to line 164 through switch 153 (which is closed) through line 173. At the same time the circuit to line 164 through switch 152 is opened, thus stopping the gear motor 145.

It should be noted, therefore, that as the fan motor 162 starts, the fan will start drawing air through the shutters, and the shutters will start to swing to their open position, thereby releasing the switch 154, opening both sets of contacts in the switch. This also therefore breaks the connection between line 165 and line 166 to the gear motor 145, and breaks the connection between line 170 and the relay 172. Relay 172 is thus reset to its normal position.

The gear motor will stay in position with the compression bars open and the fan motor 162 for the fan will continue to run until the switch 161 is turned off, either manually, by a timer or in any other desired way.

The circuit to motor 162 is completed through the switches 161 and 152 to line 167. A line 170 is also connected to line 167 and leads to the second set of contacts in the microswitch 154 from those connected to line 165, and the second set of contacts also connect through the switch 154 to a line 171 that leads to relay 172 connected on the opposite side to line 166. The relay 172 operates a set of normally closed contacts 173 (which open when the relay is energized) and the contacts 173 connect to the microswitch 153.

It should be noted that when the shutter locking mechanism is open and the fan motor 162 is powered from the signal on line 167, power to the gear motor 145 is interrupted by energizing relay 172 (and opening contacts 173) through the lines 170, one side of the switch 154, and line 171. This opens the contacts 173. Switch 153 was closed when the cam lobe 150A moved away from the position holding the switch open and the gear motor 145 is then ready to close the shutter locking mechanism. Gear motor 145 cannot be powered until the shutter blades are moved to the closed position. Once the shutter blades do move to closed position, both sets of contacts from the switch 154 are closed.

It will thus be seen that with the contacts 173 closed and the switch 153 closed, power may be provided to motor 145 through a line 174 from the source 160, independently of the manual switch 161. The only thing necessary to again operate the gear motor is for the switch 161 to be opened, shutting off the fan motor 162 and reducing the flow of air through the shutters until they close. When this happens, the shutter blades eventually will drop to their closed position actuating the switch 154 to its solid line position and closing the circuit to the gear motor 145 through lines 165 and 166. After the shutters have come to rest the gear motor 145 will be powered (as explained) and will rotate the crank disc. As soon as the cam lobe 150A moves away from the switch 152, the switch will return to its solid line position. The motor 145 will continue to operate until the cam lobe 150A contacts the switch 153, opening the switch and disabling the circuit to the gear motor through the line 174.

When the cam lobe 150A opens switch 153 the compression beams will be latched to provide the vertical force necessary for positive sealing. The switches 152 and 153 therefore control operation of the gear motor and also the fans in combination with the manually operable switch 161. Again, the switch 161 could be thermostatically controlled if desired, or operated on a timer.

This electrical diagram description is intended as an illustration of control methods. Other control methods can be applied for multiple-speed fan control, low voltage control devices, and other variations as desired and appropriate.

6. Motorized Shutter Actuator

In the form of the invention shown in FIGS. 23–25, a positive force against the main seals of the shutter assembly is provided through the use of a motorized locking mechanism which also actuates the movement of the shutters. The same insulated, lightweight shutter blades as previously disclosed are used. A linkage applys a vertical compressive force against the seals as the shutters are closed under power.

The frame is of substantially the same construction. A shutter housing 190 defines a rectilinear opening as in the previous forms of the invention and has upright walls which define an enclosure, having an outlet opening at the top, and an inlet opening 191 at the bottom.

A plurality of individual shutter blades 192 are pivotally mounted in the same manner as before, about a pivot axis 193. A "false" shutter 194 also is utilized and this pivots about a pivot 195. The end portion, to the left in FIGS. 23 and 24 and indicated at 196 is an insulated filler layer for closing the space left by the tapered free end of the aerodynamically shaped shutters.

In this particular instance, the shutters 192 are each pivotally mounted forward of their midportions to a shutter actuating link 200. The pivot connections are shown at 201, and as can be seen the link 200 has upright end portions 202 and 203. The false shutter is connected with a link 204 to the end portion 203, and it can be seen that when the shutters are actuated they will pivot to open position as shown in FIG. 24.

The upper end of upright end portion 202 has a connecting link 205 pivotally mounted thereto as at 206. The connecting link 205 extends downwardly and is pivotally mounted as at 207 to a crank member 208. The crank member 208 is drivably mounted on a lateral shaft 209 which is rotatably mounted between the side walls of housing 190, and extends generally parallel to the pivoting axis 193 of the shutters 192. Additionally, the crank 208 has a control link 212 pivotally mounted thereto as at 211 on a pivot location between the pivot 207 and the shaft 209. Link 212 in turn is pivotally mounted as at 215 to a support crank 216. The crank 216 is shaped the same as crank 208, and is pivotally mounted as at 217 to a support mounted on the frame 190. The mounting can be a depending ear supported from the side frame members.

At the lower end of the crank 216, a connecting link 219 is pivotally mounted as at 220. The link 219 extends upwardly and is mounted as at 221 to the upper end of end portion 203 of the connecting link 200. The link 204 is pivotally mounted as at 204A to the false shutter 194, and as at 204B to the portion 203 of link 200.

Shaft 209 also has a crank arm 225 drivably mounted thereon, close to a support mounting along one side of housing 190, and the crank member 225 has a connecting rod 226 mounted at the outer end thereof.

The opposite end of the connecting rod 226 is connected again through a connection 228 to a crank pin on a crank disc 231 which is driven by an electric gear motor 232 that is suitably mounted at the forward portion 196 of the frame. The motor 232 drives the crank disc 231 at a desired speed.

For operation of the powered shutter, the motor control circuit is exactly the same as shown in FIG. 21 except the switch 154 is an air velocity sensitive switch, such as a vane actuated switch which goes to the solid line position when the air velocity across the shutters drops below a set level which indicates the fan used is no longer running.

The crank disc 231 has a lobe on it to actuate micro switches 152 and 153 at the closed and open positions of the shutter in the same manner as before.

When the motor 232 is operated by turning on a switch 161, the crank disc 231 will be rotated and this will drive the connecting rod 226 from the position shown in FIG. 23, so that the shaft 209 rotates counterclockwise as shown in these figures. This then will rotate crank 208 which in turn will push on links 205 and 212. The link 205 will start to lift the end portion 202 of link 200, and the link 212 will start to pivot the crank 216 to duplicate the same lifting movement through the links 219 to lift the opposite end portion 203 of the link 200. As link 200 moves the shutter blades 192 will pivot about their pivots 193. The fan that is connected to the shutter or louver assembly is actuated by closing of a suitable limit switch such as switch 152, as the crank disc 231 starts to rotate. Air will flow in through the bottom opening 191 and will exit through the top in the normal manner. The air flow switch corresponding to switch 154 will then be actuated to its dotted line position by the air flow, and the fan will exhaust air.

With the air switch actuated (it will be set to be actuated at a low level of air flow) when the shutters have been driven to full open position the crank disc has a lobe on it which activates a switch corresponding to switch 153 to disable the motor until the air switch (154) again closes.

When the fan is to be shut off, the control switch 161 will be turned off and this will stop the fan and as soon as the air flow is reduced sufficiently so that the air flow switches corresponding to switch 154 returns to solid line position, motor 232 will be driven again, driving the crank arm 226 in compression and causing the shaft 209 to rotate in clockwise direction, thereby also rotating the crank 208 in clockwise direction as indicated by the arrow 233. This will cause the shutters to be pivoted in opposite direction, toward their closed position.

It will be seen that during the closing operation, the shutters contact the adjacent shutters and the pivoting (rotation) motion stops. Then during the final few degrees of movement of the shaft 209 and the cranks 208 and 216, the shutters are forced downward in unison against the support springs 72 described earlier and illustrated in FIGS. 9–12. The support springs deflect downward guiding the closed shutters in unison in the direction as indicated by the arrow 235, thereby tending to compress the main seals 50 and the lateral seals 50A and 86 at the spaces defined by the junctions of the shutter blades during this final part of the closing action. The use of the link 212 maintains the parallel angular motion of cranks 208 and 216 so that the end portions 202 and 203 apply a uniform load (perpendicular to and toward the plane of opening 191) at both ends of the link 200. Because the link 200 has substantial depth and thus rigidity in vertical direction, this force is applied to the pivots 201 of all of the shutters. A downward force is thus exerted individually on all of the shutters tending to cause the seals to be compressed.

When the shutters have reached full closed and locked position a cam lobe on disc 231 will actuate a switch corresponding to a switch 152, as explained previously.

An analysis of the kinematics will show that the pivoting of the crank 216 (and crank 208) from the angular position indicated by the dashed line 236 to the solid line position of the crank will result in a substantial downward force on the shutters. Additionally, the link 204 on the false shutter does not overload the false shutter in any way during this movement.

The compressing action is achieved because in locked position the line between pivots 209 and 207 of bell cranks 205 and between pivots 217 and 220 of bell cranks 216 approach perpendicular relationship to the plane of the inlet opening. The connecting links 205 and 219 are "jackknifed" relative to the bell cranks and are close to perpendicular to the inlet plane as well.

The links 205 and 219 are designed to be solid for carrying compressive loads and slightly stretchable in tension when the shutters close to load the main seals under a spring force. The links 205 and 219 each have integral ends where the pivots are located and a split center bar 205A and 205B (see FIG. 24). The split is made as a mating tongue and groove in the center. The two parts 205A, 205B or 219A, 219B abut together to be rigid during compression but may separate longitudinally during tension. The end of the links are held together by flat strips 205C, 209C of plastic on each side formed in a curved or bow shape (as for a bow and arrow). The curved flat strips form spring loads urging the portions 205A, 205B and 219A, 219B together. Tension loads on the links will tend to flatten or straighten out. The tongue and groove mating ends of the center bar section will be permitted to separate slightly under loads above a selected amount and the bow strips 205C, 219C exert a resilient force tending to pull the center bar sections together.

The link construction prevents overloading due to variation in construction tolerances and mechanically loads the seals, which is the purpose for the torsion bar loading construction of the compression beams. The ability to accommodate a fair range tolerance of construction avoids the cost of precision manufacturing.

In FIG. 25, the edge seal 50 is shown. The same type of support for the shutters can be used as in the first form of the invention having the cam surfaces that guide the shutter blades and support the shutter blades. The frame is similarly made into sections to reduce conduction of heat and vibration.

7. Summary

The shutter blades in each form of the invention are insulated heavily in direction perpendicular to the plane of the shutter inlet opening, which is another way of saying that the shutter blades resist heat transfer between the inlet and the outlet of the assembly. The blades are aerodynamically shaped, and form a parallelogram with rounded corners. At rest the free end surface of one blade overlaps the rear end surface (the surface at the pivoted end) of the adjacent blade so the shutters nest together when they close. With the use of a false shutter section at one end, each blade can pivot open and provide a substantial amount of open space for airflow when open. When the shutters close and nest together there is a substantial depth of insulation material at all points along the inlet opening, as measured perpendicular to the plane of the opening.

The main seals in all forms of the invention are subjected to positive forces in direction perpendicular to the plane of the inlet opening. When the shutters are closed the shutter blade mounting permits limited movement to accomplish the sealing action. All seal materials are selected to have low heat conduction properties.

Other seals are provided to prevent convection currents from occurring in the spaces between the shutter blades at the junctions of the adjacent blades and in the spaces between the ends of the blade and the frame sides. The anticonvection seals form air pockets along the sides of the frame by sealing on the shutter end cap shoulders. The air pockets with convection currents eliminated aid in insulation.

The two part frame, with heat conduction isolation prevents conduction from the hot to the cool side of the frame to thereby further reduce heat exchange across the unit.

While the shutters have been described in relation specifically to whole house ventilation, it is apparent that the shutter construction may be used for inlet or outlet ventilation ducts for a wide variety of applications.

The three preferred embodiments shown comprise shutter blades which open and close in response to air pressure differentials, with motor actuated or manual compression beams for locking and sealing the shutters, and an integrated motor actuated shutter and seal mechanism. The shutter blades and mountings are the same in all three embodiments. To correlate the information, the following table cross references the figures which apply to more than one of the embodiments.

| FIG. | Air pressure operated shutter version with motor actuated seals | Air pressure operated shutter version with manually actuated seals | Integrated motor shutter/seal mechanism |
|---|---|---|---|
| 1 | X | | |
| 2 | X | | |
| 3 | X | X | |
| 4 | X | X | X |
| 5 | | X | |
| 6 | | X | |
| 7 | | X | |
| 8 | X | X | |
| 9 through 18 | X | X | X |
| 19 | X | | |
| 20 | X | | |
| 21 | x | | |
| 22 | X | | |
| 23 | | | X |
| 24 | | | X |
| 25 | | | X |

In regard to the shutter blade construction in order to prevent heat conduction from the inlet side to the outlet side of the shutter the shell section 60 may be made of a low thermal conduction plastic and actually touch the lower shell section without harming the low conduction design. Further, the web or flange 61B as shown is formed to provide substantial rigidity against bending of the blades, particularly when the thickness (perpendicular to the inlet opening) is maintained at a minimum consistent with good heat transfer design. Flanges 60A, 61A and 60B, 61B may be more closely positioned than that shown.

While preferred embodiments of the invention have been described and shown in the drawings, many modifications thereof may be made by a person skilled in the art without departing from the spirit of the invention, and it is intended to protect by Letters Patent all forms of the invention falling within the scope of the following claims.

What is claimed is:

1. In a shutter apparatus for use in connection with a fan, a perimeter frame having an inlet opening which lies along a reference plane, a plurality of shutter blades mounted within said perimeter frame and movable from a first closed position wherein the blades substantially close off air passage through the inlet opening to a second position wherein air is permitted to flow through the inlet opening, the improvement comprising seal means along the edges of said inlet opening, means to mount said shutter blades for movement between their first and second positions and for limited movement toward and away from the reference plane, and linkage means to move the shutter blades in a direction generally perpendicular to the reference plane to compress the seal means with the shutter blades in the closed position.

2. The apparatus of claim 1 wherein said shutter blades are pivotally mounted, and pivot between said first and second positions, the pivotal mounting of said shutter blades including resilient means movable for a short distance in direction perpendicular to the reference plane.

3. The apparatus of claim 2 wherein the pivotal mounting of said shutter blades includes means to limit the movement of the shutter blades in direction substantially perpendicular to the inlet opening and away from the inlet opening.

4. The apparatus of claim 2 wherein said means to pivotally mount said shutter blades includes a spring having a leg that resiliently moves in direction toward and away from said inlet opening, said shutter blades each having cam means thereon, said cam means having a surface facing outwardly from the pivot axis of the shutter blades, and a mating surface on said frame, said cam surface engaging said mating surface, and said spring means urging said cam means and said mating surface together.

5. The apparatus of claim 4 wherein said cam means further includes a portion defining a second cam surface which engages a portion of said frame member only when the shutter blades pivot to adjacent their open positions to support the shutter blades directly on the frame when the shutter blades are in open positions.

6. The combination as specified in claim 4 wherein said spring means comprises a support leg extending generally parallel to a side member of said frame, and an arm integral with the leg and extending outwardly to form the pivot of said shutter blades, said spring means being positioned on opposite sides of each shutter blade, and pivotally mounting each shutter blade about an axis extending transverse to the direction of extension of said main seal means.

7. The apparatus of claim 6 wherein said shutter blades are positioned adjacent to each other, and have free end surfaces extending parallel to the pivot axis which taper at an acute angle relative to the reference plane of the inlet opening and overlie a mating adjacent second surface, and second seal means extending between shutter blade free end surfaces and engaging the mating adacent second surface when the shutter blades are moved to closed position.

8. The apparatus of claim 1 wherein each of said shutter blades comprises a shell of substantial thickness in direction perpendicular to the reference plane of the opening in the midportions thereof, said shutter blades being generally parallelogram form in cross section with the largest diagonal corner to corner distance extending from adjacent the reference plane and at one edge of each of the blades diagonally in direction away from the reference plane to an opposite edge of the blade, said shutter blade shells being filled with an insulation material to provide a rigid structure with a substantial amount of resistance to heat transfer in direction perpendicular to the reference plane.

9. The apparatus of claim 8 wherein the shutter blade edge surfaces are aerodynamically curved at the junctions of surfaces across which air flows.

10. The apparatus of claim 8 wherein the shutter blades are pivoted to the frame adjacent the one edge and adjacent the reference plane, each shell forming a lip extending therefrom adjacent the pivot axis and generally parallel to the reference plane, the free edge of the next adjacent shutter blade overlying said lip, and second seal means including a seal positioned on said lip and in position to be engaged by a portion of the free edge of the next adjacent shutter blade across the transverse width of the shutter blades.

11. The apparatus of claim 1 and power means to operate said linkage means to exert a force perpendicular to the reference plane.

12. The apparatus of claim 2 wherein said linkage means comprises a pair of compression beams pivotally mounted on said frame adjacent the ends of the blades and extending generally perpendicular to the pivot axis of the shutter blades, said compression beams being on a side of said shutter blades opposite from the inlet opening when the shutter blades are closed and having a portion movable from a first position overlying the shutter blades in closed position to a second position wherein the compression beams do not interfere with movement of the shutter blades, and means to move the compression beams to their first position and to exert a force on the shutter blades urging the blades against the seal means.

13. The apparatus of claim 1 wherein said linkage means includes a spring member coupled between the frame and shutter blades to exert a resilient force on the shutter blades to tend to resist movement of the shutter blades perpendicular to the reference plane.

14. The apparatus of claim 1 wherein said linkage means comprises a pivoting means engageable with said shutter blades and actuable to exert a force substantially perpendicular to the reference plane as the pivoting means are pivoted to a locked position.

15. The apparatus of claim 14 wherein said pivoting means comprise a pair of compression beams mounted adjacent the ends of the shutter blades and extending to span all of the shutter blades, said compression beams each being pivoted along a first edge and having a second edge movable from a position spaced from the shutter blades so they open and close, to a position bearing against the shutter blades on sides of the shutter blades opposite the inlet opening.

16. The apparatus of claim 1 wherein said frame has first and second generally coextensive overlying perimeter frame sections spaced apart to form a thermal conduction break around the perimeter, insulating block means connected to the two perimeter frame sections to support the perimeter frame sections relative to each other, and means formed of material having low thermal conductivity to seal the space between the perimeter frame sections around the perimeter thereof.

17. A shutter apparatus comprising a perimeter frame member having frame side members, a plurality of shutter blades extending between the frame side members, means to pivotally mount said blades to the frame side members about generally parallel axes normal to the frame side members, flange means on the frame side members defining sides of an inlet opening, the ends of the shutter blades overlying the flange means, said blades pivoting between open and closed positions, said blades having edges which overlie adjoining laterally extending surfaces extending in direction between the frame side members with the shutter blades in closed position and which edges move away from the adjoining surfaces as the shutter blades move to open position, first seal means extending in direction between the frame side members and in position between each of the shutter blade edges and the respective adjoining laterally extending surface, second seal means between the flanges and the overlying ends of the shutter blades, and linkage means mounted on said frame and operably associated with the shutter blades, said linkage means being movable to a position to apply a positive force tending to move the shutter blades toward the inlet opening with the shutter blades in closed position to tend to compress the first and second seal means.

18. The apparatus of claim 17 wherein said means to pivotally mount said blades comprise resilient members that permit a limited amount of movement of said blades toward and away from the sealing means.

19. The apparatus of claim 17 wherein said shutter blades comprise insulated blades having a substantial thickness in direction normal to the inlet opening, and being generally parallelogram shaped in cross section normal to the pivot axis of shutter blades, the pivot axis being adjacent the inlet opening and lying adjacent a corner of the cross section forming with the diagonally opposite corner the longer diagonal line of the parallelogram so that the edges of the blades overlap other blades, the first and second seal means being positioned adjacent the inlet opening, the edges of each of the blades spaced from the inlet opening and at the diagonally opposite corner from the pivot axis overlying an adjacent mating surface, and a third seal means between the diagonally opposite corners and its adjacent mating surfaces to inhibit convective airflow in the spaces between the mating surfaces.

20. The apparatus of claim 19 and fourth seal means between each of the frame side members and the adjacent ends of the shutter blades with the shutter blades in closed position, said fourth seal means being spaced from the inlet opening a desired amount to form an air pocket.

21. The apparatus of claim 20 wherein the ends of said shutter blades comprise end caps having shoulder surfaces formed thereon and positioned to extend in direction parallel to and facing the plane of the inlet opening, said fourth seal means comprising a separate resilient blade element mounted on each frame side member and positioned so the shoulder surfaces of the adjacent end caps engage the respective blade element as the shutter blades move to closed position.

22. The apparatus of claim 18 and power means to operate said linkage means.

23. The apparatus of claim 22 and electrical control means operative to energize a ventilating fan motor as a function of the position of the linkage means.

24. The apparatus of claim 18 wherein said linkage means comprises a pair of compression beams extending along the frame side member on opposite sides thereof, rod means pivotally mounted on the frame adjacent and parallel to the respective frame side members, each of the compression beams being elongated and having longitudinally extending side edges and each being supported on one of said rod means along one side edge and thereby being pivotally mounted relative to the frame, the opposite side edges of said compression beams being movable as the beams are pivoted from a first position overlying the end portions of all of the shutter blades to a position clearing the shutter blades to permit them to pivot open, and means to pivot said rods to move the opposite side edges of the compression beams into engagement with the shutter blades and exert a force on the shutter blades urging the shutter blades against the first and second seal means.

25. The apparatus of claim 24 and means to connect the compression beams to the respective rod at only one position along the length thereof to cause the respective compression beam to pivot with the rod, the means to pivot said rods being connected at one end of each rod only, whereby the rods will load the respective compression beam under a torsion load from the respective rod.

26. The apparatus of claim 18 wherein said linkage means includes a portion to control pivotal movement of the shutter blades comprising first crank means pivotally mounted at a first end thereof to the frame adjacent one end of the frame and second crank means pivotally mounted at a first end thereof to the frame adjacent a second end of the frame, the pivots of the first and second crank means being spaced from the inlet opening, and the crank means being to the outside of first ends of the shutter blades, a control link pivotally mounted to the first end of each shutter blade to cause said shutter blades to pivot in unison, a connecting link between respective second ends of the crank means opposite the first ends thereof and the respective ends of the control link, whereby pivotal movement of one crank means causes the shutter blades to be pivoted and guided by the crank means, the control link and the connecting links as they pivot.

27. The apparatus of claim 19 and a false shutter made of insulating material pivotally mounted to the frame and overlapping the edge of one end shutter blade which is the pivoting edge of such blade, means to cause said false shutter to pivot in direction away from the one end shutter blade as the shutters pivot to open position, the linkage means also acting on the false shutter blade.

28. A shutter apparatus comprising a perimeter frame assembly comprising two frame sections, each frame section having spaced frame side members and end members extending between the side members, the frame sections being substantially coextensive and defining an opening having an inlet at one frame section and an outlet at the other frame section, a plurality of shutter blades each pivotally mounted to the frame assembly about a pivot axis and being movable about their pivot axes from an open position to permit airflow through the inlet to the outlet to a closed position blocking airflow through the defined opening, each of said shutter blades comprising an outer shell, a filling of foam material within said outer shell, said outer shell being formed to have an interior shutter blade surface facing the inlet and an exterior shutter blade surface facing the outlet, said shell having two portions which form a thermal conduction path of low thermal conductivity between the interior shutter blade surface and the exterior shutter blade surface to inhibit heat conduction from the inlet to the outlet when the blades are in closed position, each shutter blade further including end cap means of material having low thermal conductivity, the pivotal mounting for each shutter blade comprising means mounted on the respective end cap means, the pivotal mounting axis for each blade being adjacent one edge of such blades, said first and second frame sections being spaced apart to form a thermal conduction break around the perimeter of the frame to prevent heat conduction directly between the first and second frame sections, and insulating means connected to the frame sections to support the frame sections relative to each other, and to seal the space between the frame sections around the perimeter thereof.

29. The shutter blade of claim 28 wherein said foam and said end cap means form the only structural connection between said two shell portions forming the interior surface and the exterior surface of the shutter blade.

30. A shutter apparatus for use in connection with a fan including a perimeter frame having an inlet opening which lies along a reference plane and having first and second sides and first and second ends, a plurality of shutter blades mounted within said perimeter frame and each extending in direction between the sides of the frame and movable from a first position wherein the blades substantially close off air passage through the inlet opening to a position wherein air is permitted to flow through the inlet opening, seal means along the edges of said inlet opening, means to pivotally mount said shutter blades for movement about axes extending between the frame sides between their first and second positions, the seal means being engaged by the shutter blades in their first position, the means to pivotally mount further permitting movement of the shutter blades generally perpendicular to the plane of the inlet opening to compress the seals with the shutter blades in their second position, means to control movement of the shutter blades comprising first crank means pivotally mounted at a first end thereof to the frame adjacent one end of the frame and second crank means pivotally mounted at a first end thereof to the frame adjacent a second end of the frame, both crank means being positioned adjacent one side of the frame, a control link pivotally mounted to each shutter blade at one end of each of the shutter blades and extending parallel to the one side of the frame to cause said shutter blades to pivot in unison, connecting links between respective second ends of the first and second crank means opposite the first ends thereof and the respective ends of the control link, whereby pivotal movement of one crank means causes the shutter blades to be guided by both of the crank means, the control link and the connecting links, the means to control including means to exert a force on the shutter blades generally perpendicular to the plane of the inlet opening through the crank means when the shutter blades approach their first position.

31. The apparatus of claim 30 and a second control link pivotally mounted to both of the crank means and being substantially parallel to the first mentioned control link, the lines between the pivotal mounting of the respective crank means and the mounting of the crank means to the first control link being substantially parallel.

32. The apparatus of claim 31 wherein the first crank means is mounted on a shaft which pivots relative to the frame, and power means to rotate said shaft.

33. The apparatus fo claim 31 wherein the first mentioned control link has end portions at each end extending in direction away from the inlet opening, the pivotal mounting of the crank means being positioned so that the crank means extend from the pivotal mounting in direction toward the inlet opening when the shutter blades are adjacent a closed position, and in that position said connecting links extend from the opposite ends of the respective crank means in direction away from the inlet opening to their connection with the opposite ends of the first mentioned control link.

34. A shutter apparatus including a frame having an inlet opening which lies generally along a reference plane, a plurality of shutter blades pivotally mounted to said frame and movable from a first position wherein the shutter blades cooperate to substantially close off air passage through the inlet opening to a position wherein the shutter blades become spaced apart and air is permitted to flow through the inlet opening, means to mount said shutter blades for pivotal movement between their first and second positions, each shutter blade having end cap means at opposite ends thereof, and the means to pivotally mount each shutter blade comprising a pair of springs, one at each of the opposite ends of each shutter blade and including a support leg portion extending generally perpendicular to the axis of pivot of the shutter blade, and an arm portion extending generally parallel to the pivot axis of the respective shutter blade and engaging the respective end cap, the arm portions of each pair of springs for each shutter blade forming pivot members at the opposite ends of the respective shutter blade and permitting the shutter blade to move toward and away from the inlet opening a limited amount under torsion loading of the support leg portion.

* * * * *